US009810210B2

(12) United States Patent
Bassani

(10) Patent No.: US 9,810,210 B2
(45) Date of Patent: Nov. 7, 2017

(54) PERISTALTIC PUMP

(71) Applicant: CAPMATIC LTÉE, Montreal-Nord (CA)

(72) Inventor: Loris Bassani, Montreal (CA)

(73) Assignee: CAPMATIC LTEE, Montreal-Nord (CA)

( * ) Notice: Subject to any disclaimer, the term of this patent is extended or adjusted under 35 U.S.C. 154(b) by 400 days.

(21) Appl. No.: 13/687,127

(22) Filed: Nov. 28, 2012

(65) Prior Publication Data

US 2014/0086771 A1 Mar. 27, 2014

(30) Foreign Application Priority Data

Sep. 26, 2012 (CA) ..... 2791344

(51) Int. Cl.
*F04B 43/12* (2006.01)

(52) U.S. Cl.
CPC ..... *F04B 43/12* (2013.01); *F04B 43/1261* (2013.01); *F04B 43/1284* (2013.01); *F04B 43/1292* (2013.01)

(58) Field of Classification Search
CPC .. F04B 43/12; F04B 43/1253; F04B 43/1284; F04B 43/08; F04B 43/0072; F04B 43/123; F04B 43/1238; F04B 43/1261; F04B 43/1292
USPC ..... 417/474, 476, 477.1, 477.11, 477.9, 417/477.4, 477.6, 477.8, 477.2, 360, 475
See application file for complete search history.

(56) References Cited

U.S. PATENT DOCUMENTS 4,178,138 A * 12/1979 Iles ..... 417/360
4,673,334 A * 6/1987 Allington ..... F04B 43/1292 417/475
4,735,558 A * 4/1988 Kienholz ..... F04B 43/1284 417/477.2
4,813,855 A * 3/1989 Leveen ..... F04B 43/1284 417/477.9
4,886,431 A * 12/1989 Soderquist ..... F04B 43/1292 417/477.11
5,213,483 A * 5/1993 Flaherty ..... A61M 5/14232 417/474
5,257,917 A * 11/1993 Minarik ..... F04B 43/1292 417/475
6,019,582 A 2/2000 Green
6,494,692 B1 12/2002 Green
(Continued)

FOREIGN PATENT DOCUMENTS

FR WO 2006008376 A1 * 1/2006 ..... F04B 43/1253

*Primary Examiner* — Theodore Stigell
*Assistant Examiner* — Jon Hoffmann
(74) *Attorney, Agent, or Firm* — Greenblum & Bernstein, P.L.C.

(57) ABSTRACT

The invention provides a peristaltic pump. The pump has a cavity for receiving a rotor and a flexible conduit, the rotor engaging the flexible conduit to displace fluid therein. A conduit retainer mechanism is provided for engaging the flexible conduit to assist with retention of the conduit in the cavity against displacement resulting from engagement between the conduit and the rotor. The conduit retainer mechanism including first and second jaws opposite to one another, defining between them a passageway for receiving the conduit, wherein one of the first and second jaws are spring biased to resiliently engage the conduit.

8 Claims, 12 Drawing Sheets

(56) References Cited

U.S. PATENT DOCUMENTS

| | | | | |
|---|---|---|---|---|
| 8,062,008 | B2 * | 11/2011 | Voltenburg, Jr. . | A61M 5/14232 417/477.2 |
| 8,083,503 | B2 * | 12/2011 | Voltenburg, Jr. . | A61M 5/14232 417/477.11 |
| 2005/0196307 | A1 * | 9/2005 | Limoges | 417/476 |
| 2009/0087326 | A1 * | 4/2009 | Voltenburg, Jr. . | A61M 5/14232 417/477.2 |
| 2010/0008755 | A1 | 1/2010 | McDowell et al. | |
| 2010/0129247 | A1 * | 5/2010 | Lauer | 417/477.8 |
| 2011/0300010 | A1 * | 12/2011 | Jarnagin | A61B 17/3207 417/477.2 |

* cited by examiner

PERISTALTIC PUMP

FIELD OF THE INVENTION

The present invention relates to devices for dispensing a predetermined quantity of liquid in containers. More specifically, the invention relates to a peristaltic pump for delivering measured amounts of liquid and to techniques for controlling the operation of the peristaltic pump.

BACKGROUND OF THE INVENTION

Many pharmaceutical and cosmetic compositions are commercialized in vials made of plastic or glass. The vials are filled at the factory by automated filling equipment. A typical automated filling station includes several modules having different functions. There is a container feeding module that supplies empty vials on a conveyor belt delivering the vials to a filling module dispensing in each vial it predetermined quantity of liquid. A capping module applying caps to the individual vials then closes the vials.

An important consideration when filling vials with pharmaceutical compositions, such as injectables, is the prevention of contamination. Since a filling station will typically be used to dispense a wide range of different products it is important to thoroughly clean the station from one production run to another. The cleaning operation is time-consuming because it requires disassembling the various components of the machine that are in contact with the dispensed liquid. In addition to the disassembly operation, the components need to be totally cleaned and sterilized before put back together for a subsequent production run.

One of the most difficult components to clean is the pump used for dispensing the liquid. Pumps that use reciprocating pistons require complete disassembly of the pumping chamber including removal of all seals to expose all surfaces that may have come into contact with the liquid.

To facilitate the cleaning operation the industry is now accusing peristaltic pumps in which the dispensed liquid is contained in a flexible conduit and never comes in contact with the components of the pump that perform the liquid expulsion into the vials. When a production run is completed and the machine is prepared for a new production run it suffices to replace the flexible tubing through which the liquid has been dispensed with a new one.

With such pump design, the cleaning of the filling station can be made much more quickly, which saves time and ultimately increases the productivity since the machine down time is reduced.

A typical peristaltic pump has a pump body defining a cavity in which is placed a rotor. The conduit made of flexible material through which the liquid circulates is placed between the rotor and the pump body. Lobes on the rotor engage the flexible tube and constrict it. As the rotor turns, the constrictions trap a certain amount of liquid in the tube and displace it, thus producing a pumping action.

When a production run on a filling station that uses a peristaltic pump is completed, the flexible tubing is discarded and replaced by new tubing, which may need to be of different diameter. To allow the pump to operate with a different tube size, a holder is required which is designed for that particular tube size. The operator, therefore, needs to remove from the pump the holder for the previous tube size and replace it with a holder for the tube size that will now be used.

This operation may sometimes be overlooked with the result that the pump may be put back in operation with the improper tube holder. This may result in situations where the flexible conduit is no longer held adequately in the pump body and may move as the lobes of the rotor engage the tube.

For a peristaltic pump to dispense with precision a preset quantity of liquid the flexible tube must be held stationary with relation to the pump body. This is especially true when the individual doses that are delivered in the vials are small, in the order of a couple of cubic centimeters. Any relative movement of the tube with relation to the pump body is likely to change the quantity of liquid delivered, such that there will be a variation in the amount of liquid that is actually dispensed from the nominal quantity the vial should be holding.

From that perspective, there is a need in the industry to provide an improved peristaltic pump allowing performing tube changeover operations with reduced risk of wrongly setting the pump for a new production run.

SUMMARY OF THE INVENTION

As embodied and broadly described herein, the invention provides a peristaltic pump. The pump has a cavity for receiving a rotor and a flexible conduit, the rotor engaging the flexible conduit to displace fluid therein. A conduit retainer mechanism is provided for engaging the flexible conduit to assist with retention of the conduit in the cavity against displacement resulting from engagement between the conduit and the rotor. The conduit retainer mechanism including first and second jaws opposite to one another, defining between them a passageway for receiving the conduit, wherein one of the first and second jaws are spring biased to resiliently engage the conduit.

As embodied and broadly described herein, the invention further provides a peristaltic pump having a pump body defining a cavity receiving a rotor and a flexible conduit, the rotor engaging the flexible conduit to displace fluid therein. The pump body including a pump body base and a pump body cover, the pump body cover being separable from the pump body base to open the cavity and expose a side wall of the rotor, allowing placement of the flexible conduit on the side wall of the rotor. A lifting handle is provided on the cover configured to be gripped with one hand for lifting the cover from the pump body base.

As embodied and broadly described herein, the invention yet provides a pumping apparatus for simultaneously delivering measured amounts of different liquids to a plurality of container filling machines. The pumping apparatus includes a plurality of peristaltic pumps, each pump capable to deliver measured amounts of liquid to a respective container-filling machine, and an instrument for measuring an amount of liquid delivered from two or more pumps from the plurality of pumps. A pump control is provided for performing calibration of the two or more pumps. The pump control is configured for directing a pump selected among the plurality of pumps to deliver an amount of liquid to the instrument, and receives from the instrument data indicative of the actual quantity of liquid delivered. The pump control processes the data to determine if an error in the amount of liquid delivered exists and operates the pump such as to reduce a magnitude of the error.

As embodied and broadly described herein, the invention further provides a pumping station for use in a container-filling machine including an empty container feeding station. The pumping station includes a peristaltic pump for pumping measured amounts of liquid and dispensing the measured amounts of liquid in empty containers fed by the container feeding station, and a pump control for performing a procedure for comparing an actual amount of liquid delivered by the peristaltic pump to a pre-set amount. The pump control is configured for generating a first control signal to the empty container feeding station to direct the empty container feeding station to stop feeding empty containers and for generating a second control signal for causing the pump to discharge an amount of liquid to an instrument for measuring a quantity of liquid discharged.

DESCRIPTION OF A SPECIFIC EXAMPLE OF IMPLEMENTATION

Figure 1:
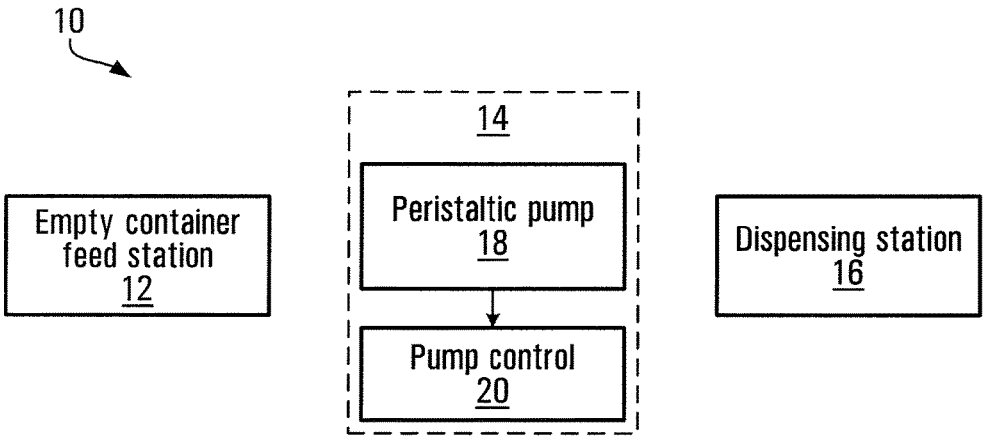
FIG. 1 is a block diagram of a container-filling machine showing the main components of the machine.
Figure 2:
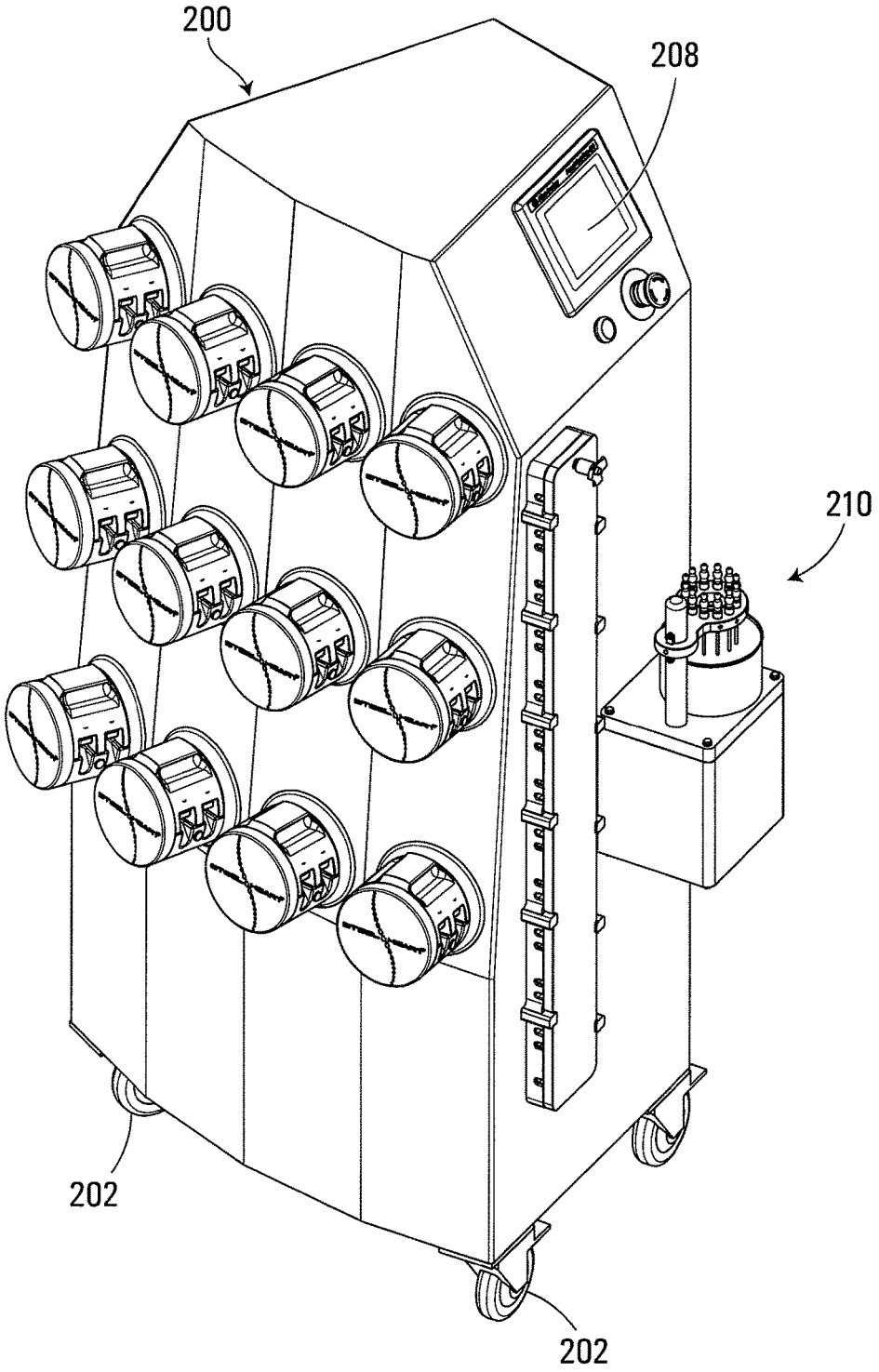
FIG. 2 is a perspective view of a modular pumping cart for use in the filling machine of FIG. 1.
Figure 3:
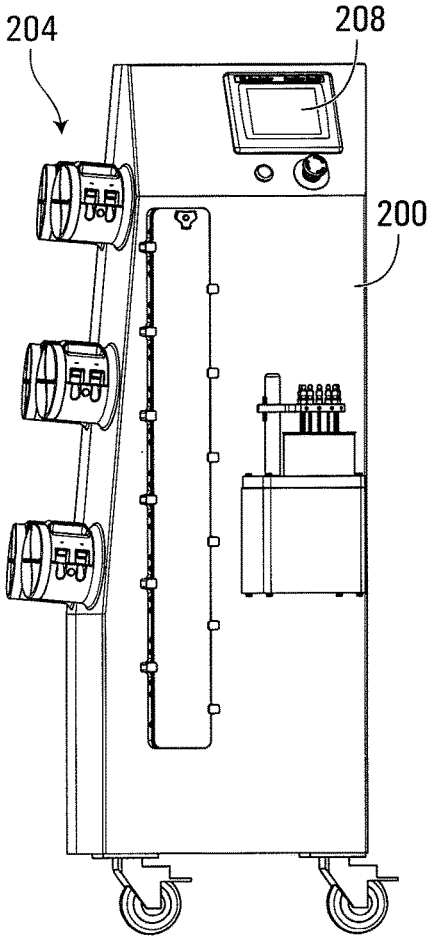
FIG. 3 is a side elevational view of the modular pumping cart shown in FIG. 2.
Figure 4:
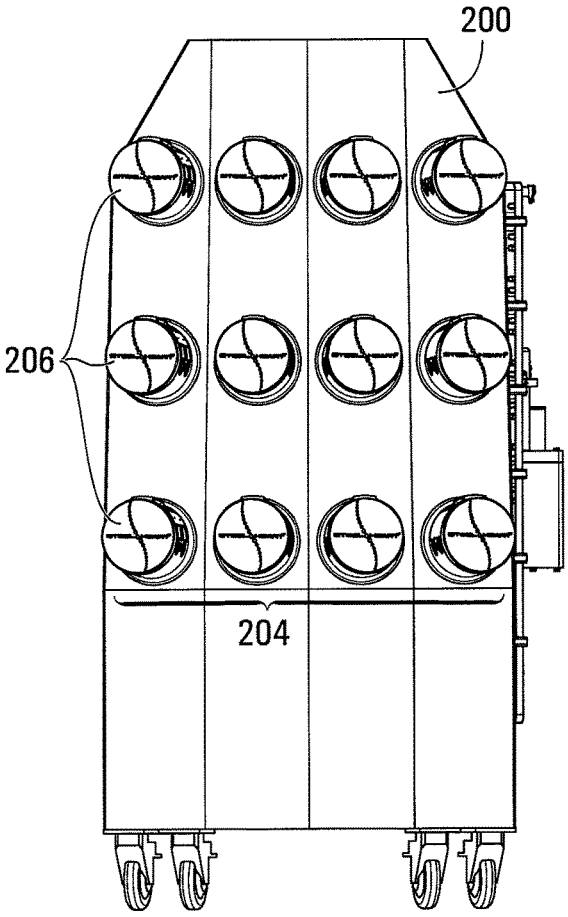
FIG. 4 is a front elevational view of the pumping cart of FIG. 2.
Figure 5:
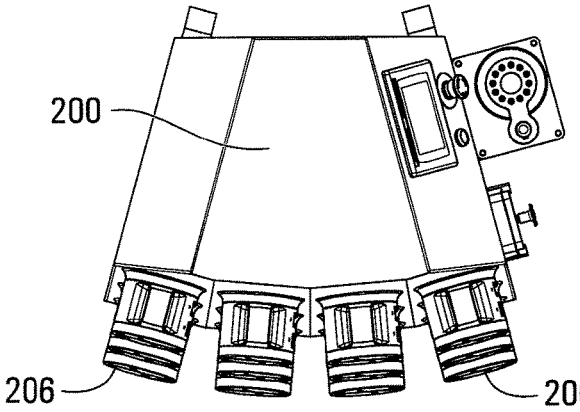
FIG. 5 is a top plan view of the pumping cart shown in FIG. 2.

FIG. 1 is a block diagram of a typical container-filling machine, illustrating the main components or stations of that machine. More specifically, the container-filling machine 10, has an empty container feed station 12 that essentially supplies empty containers on a conveyor belt (not shown) in which a predetermined quantity of liquid is to be dispensed. The empty container feed station 12 is supplied from a bin of empty containers (not shown). Typically the empty container feed station 12 will unscramble the containers, in other words orient them such that the opening is on top and will place them on the conveyor belt such that they are regularly spaced on the belt.

A pumping station 14, which is supplied with liquid to be dispensed in the individual containers, discharges individual doses of the liquid in each empty container through a dispensing station 16. The dispensing station 16 includes one or more delivery nozzles (not shown) in fluid communication with the pump. During a dispensing cycle, the nozzles are lowered into a batch of empty containers to feed the containers. When the dispensing operation is completed, the nozzles are raised and the filled containers proceed to yet another station of the filling machine where they are closed with caps.

The pumping station 14 includes a peristaltic pump 18 and an electronic pump control 20. The pump control 20 regulates the operation of the peristaltic pump 18. More specifically, the electronic pump control 20 determines when the pump starts, stops and how long the pump will run, which in turn determines the amount of liquid dispensed during each cycle. In addition, the pump control 20 performs some higher-level functions such as self-calibration of the pump and periodic checking of the amount of fluid dispensed while the filling machine 10 is in operation.

With specific reference to FIGS. 2, 3, 4 and 5 the pumping station 14 is implemented as a modular pumping cart provided with an array of individual and independent pump modules allowing the pumping cart to operate multiple filling machines at the same time. In this arrangement, each pumping module is operated independently of the other pumping modules.

The pumping cart 200 has a cabinet supported on casters 202 for moving the pumping card 200 on the plant floor. The pumping cart 200 is provided on its front side with an array 204 of individual pumping modules 206 that are arranged to be conveniently accessible by the operator to install or remove therefrom the flexible tubing through which the liquid to be pumped is circulated. The array 204 has rows and columns leaving enough space between the individual pumping modules 206 to allow for the tubing to be run and also the individual pumping modules 206 to be opened for maintenance and installation.

The electronic pump control 20 is located inside the cabinet of the cart 200. The electronic pump control 20 will be described in greater detail later.

A control panel 208 is provided in front of the cabinet for allowing the operator to enter commands. It is preferred to use a control panel with a touch sensitive screen, although physical buttons can also be used. Generally, the operator sets the operation of the individual pumping modules 206 via the control panel 208. The operator can specify parameters such as the amount of liquid to be dispensed at each cycle, the cycle dispensing frequency, in other words how many dispensing cycles will be run in a predetermined amount of time, parameters of the liquid itself such as its density, among others. The operator can perform this definition independently for each pumping module 206.

On the side of the cabinet of the pumping cart 200 is provided a scale 210 that is used to weigh a dose of liquid dispensed by anyone of the pumping modules 206. The scale 210 thus allows determining with high level of precision the exact quantity of liquid delivered during a dispensing cycle. The quantity of liquid delivered is dependent on the range of angular movement of the rotor shaft during the dispensing cycle. In turn, this information is used to calibrate the pump or to readjust it's setting if the pump has drifted and it is dispensing an amount different from what was set previously.

Inside the pumping cart 200 is provided a valve assembly (not shown) that can selectively divert a dose of liquid discharged by any one of the pumping modules 206 to the scale 210. In this fashion, the weight of the dose can be determined for performing calibration or checking for dispensing accuracy. The valve assembly is controlled by the pump control 20 as it will be discussed in greater detail later.

Figure 6:
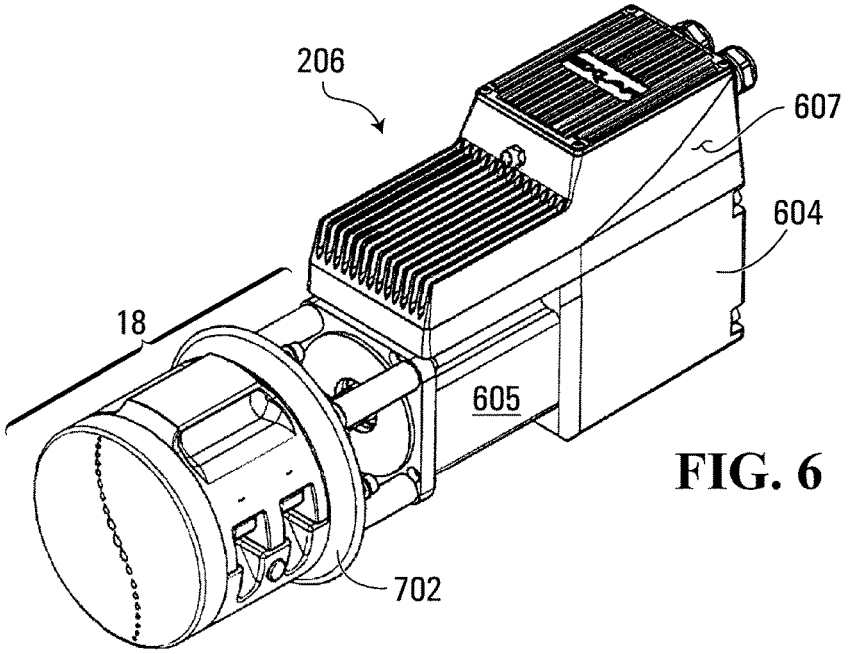
FIG. 6 is a perspective view of an individual pumping module for use in the pumping cart of FIG. 2.

FIG. 6 is a perspective view of a pumping module 206. The pumping module 206 includes a peristaltic pump 18 mounted to a drive 604. The drive 604 includes an electric motor 605 and the associated drive circuitry 607 for controlling the angular motion of the motor 605. In one possible form of implementation, the electric motor 605 is a stepper motor and the drive circuitry controls the angular movement of the shaft by sending control signals commanding rotation in a predetermined direction over an angular range defined in terms of "pulses". A pulse corresponds to the smallest angular movement the motor 605 can perform. Since the amount of liquid dispensed at each dispensing cycle is dependent on the degree of movement of the motor shaft over the cycle, the quantity of liquid dispensed can this be defined in terms of "pulses" imparted to the motor shaft.

Another option is to use a servomotor that uses encoders, which can precisely determine the angular position of the motor shaft. The drive circuitry, therefore, sends a signal to actuate the motor, while observing the output of the encoder to determine the shaft position. Once the desired position is reached, the shaft is stopped.

In both examples, the angular movement of the shaft can be precisely controlled to determine the amount of liquid that will be dispensed at each cycle.

The configuration of the drive 604 is such that the electric motor 605, servo or stepper, shares a common housing with the drive electronics 607. In this fashion, the signal connections and the electric power connections between the drive electronics 607 and electric motor 605 are contained in the housing itself. The only external connections required running the pumping module 206 is the electrical supply cables and data cables from the electronic pump control 20 to control the operation of the electric motor 605.

Figure 7:
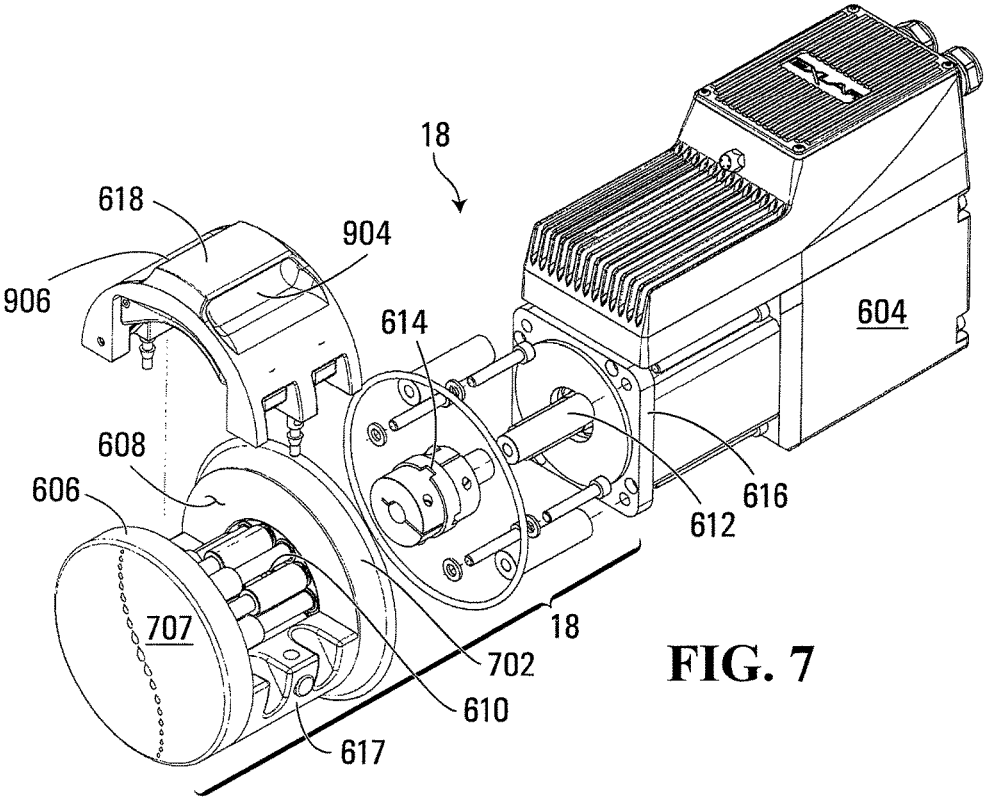
FIG. 7 is a perspective, enlarged and exploded view of the pumping module of FIG. 6.
Figure 8:
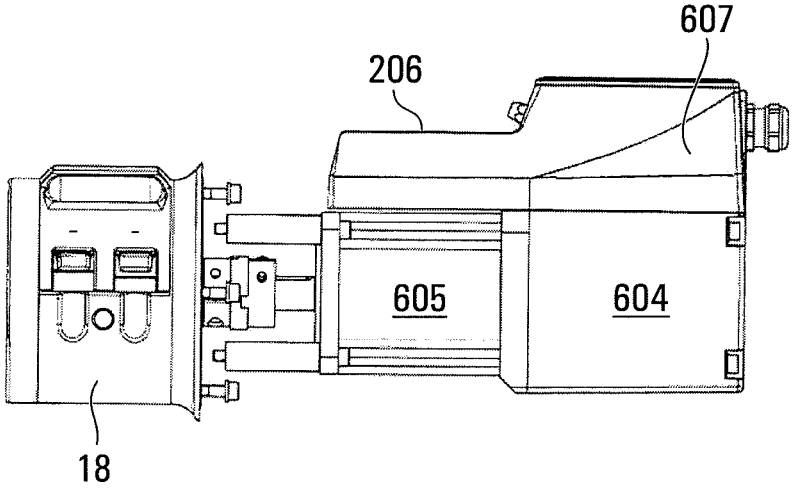
FIG. 8 is a side elevational view of the pumping module of FIG. 6.

As best shown in FIG. 7, the pump 18 has a pump body 606 defining a cavity 608 in which is mounted a rotor 610. The rotor 610 connects to the shaft 612 of the electric motor 605 via a coupling 614. The pump 18 mounts to a flange 616, which is an integral part of the housing of the electric motor 605. In this fashion, the entire pumping module 206 is self-supporting.

One possibility of mounting the pumping module 206 into the pumping cart 200 is by using a rack system. Such rack system uses for each pumping module 206 a cavity with guides in which the pumping module 206 can slide. The bottom of the housing that faces the back of the pumping module 206 is provided with electric terminals engaging corresponding connections on the back of the pumping module 206.

Such an arrangement allows quickly and easily installing and removing the pumping module 206 for replacement or maintenance. It also makes it possible to add to the pumping cart 200 additional pumping modules 206 as desired. In other words, the pumping cart 200 can be purchased with a few pumping modules 206 installed and upgraded with additional pumping modules 206 in the empty bays as the need arises.

Figure 9:
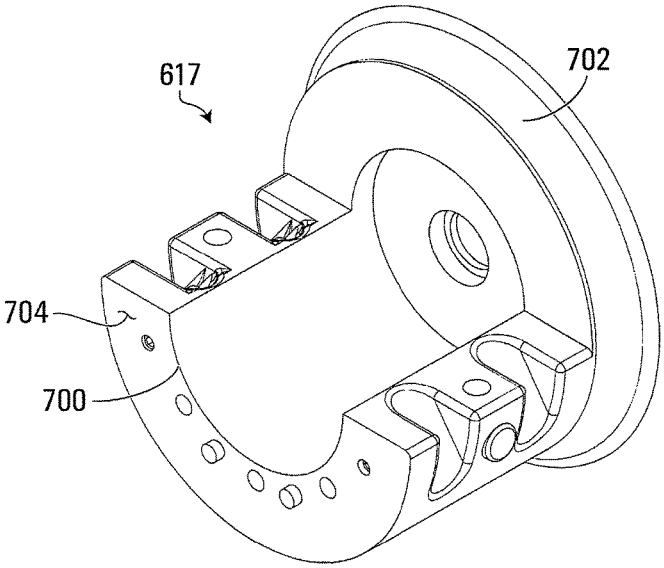
FIG. 9 is a perspective view of a pump body base of a pump body.
Figure 10:
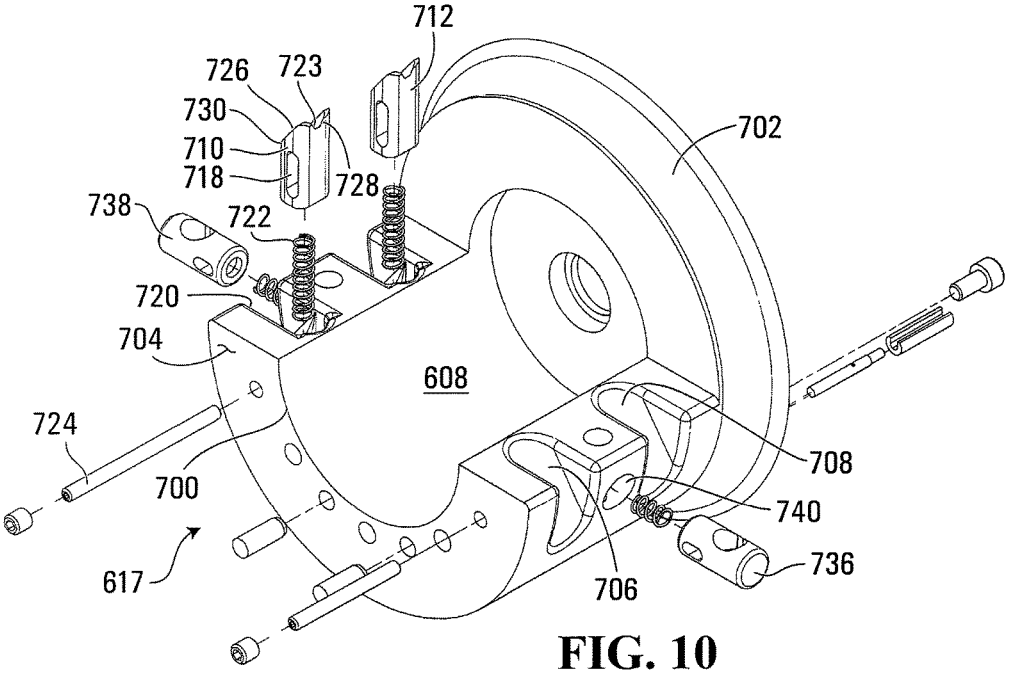
FIG. 10 is it similar to FIG. 9, illustrating additional components used for retaining a flexible tube in the pump body.

The pump body 606 includes a pump body base 617 and a cover 618. As shown in the drawing, the cover 618 can be removed to expose the cavity 608 for installation and removal of the flexible conduit. The structure of the pump body base 617 is illustrated in greater detail in FIGS. 9 and 10. The pump body base 617 is made integrally of metallic material. In material of choice is stainless steel.

The pump body base 617 is generally semi-cylindrical and has at its rear end a flange 702. The front-end 704 of the pump body base 617 is flat and receives a circular cover plate 618 (see FIG. 7).

The pump body base 617 has on one side a pair of longitudinally spaced apart notches 706 and 708 for receiving the flexible conduit through which the liquid is pumped. On the opposite side, the semi-cylindrical body 700 is provided with a conduit retainer mechanism for engaging the conduit to prevent displacement of the conduit resulting from engagement between the conduit and the rotor 610.

The conduit retainer mechanism includes a series of jaws that resiliently engage the conduit from opposite sides and prevent the conduit from moving when the lobes of the rotor engage the outer surface of the conduit in rolling contact. More specifically, the conduit retainer mechanism includes a lower set of jaws 710 and 712 mounted to the pump body base 617 and upper set of jaws 714 and 716 that are mounted to the cover 618.

The jaw 710 is made of metallic material and has an elongated body extending along a generally vertical axis. A slot 718 is machined into the body along the longitudinal axis. The length of the slot defines the range of movement of the jaw 710 which relation to the pump body base 617. The jaw 710 is slidingly received in a pocket 720 on the pump body base 617, which is generally opposite the notch 706. A coil spring 722 is placed between the jaw 710 and the bottom of the pocket 720, thus resiliently urging the jaw 710 to project from the pocket 720. A stud 724 extends through the slot 718 and controls the range of movement of the jaw 710 in the pocket 720. Under the influence of the coil spring 722, the jaw 710 projects from the pocket 720, and it is retained in that position by the stud 724 abutting against the bottom of the slot 718.

Similarly, when the jaw 710 is pushed into the pocket 720 against the resiliency of the coil spring 722, the top of the slot 718 will engage the stud 724 to prevent further downward movement of the jaw 710.

The jaw 710 has a top slanted face 726 that constitutes the flexible conduit engaging face. The conduit engaging face 726 has an extent defined between a front edge 728 and a back edge 730. A recess 723 runs on the face 726 from the front edge 728 to the back edge 730. The recess is designed to receive the flexible conduit through which liquid is pumped.

The structure of the jaw 712 is identical to the jaw 710 and a detailed description of the jaw 712 will not be provided. Note that a common stud 724 retains both jaws 710 and 712 to the pump body base 617.

The pump body base 617 further includes a pair of quick release latches 736 and 738 that are mounted in respective pockets 740 (for the quick release latches 736). The quick release latches 736 and 738 are biased by coil springs and are used to secure the cover 618 to the pump body base 617.

Figure 11:
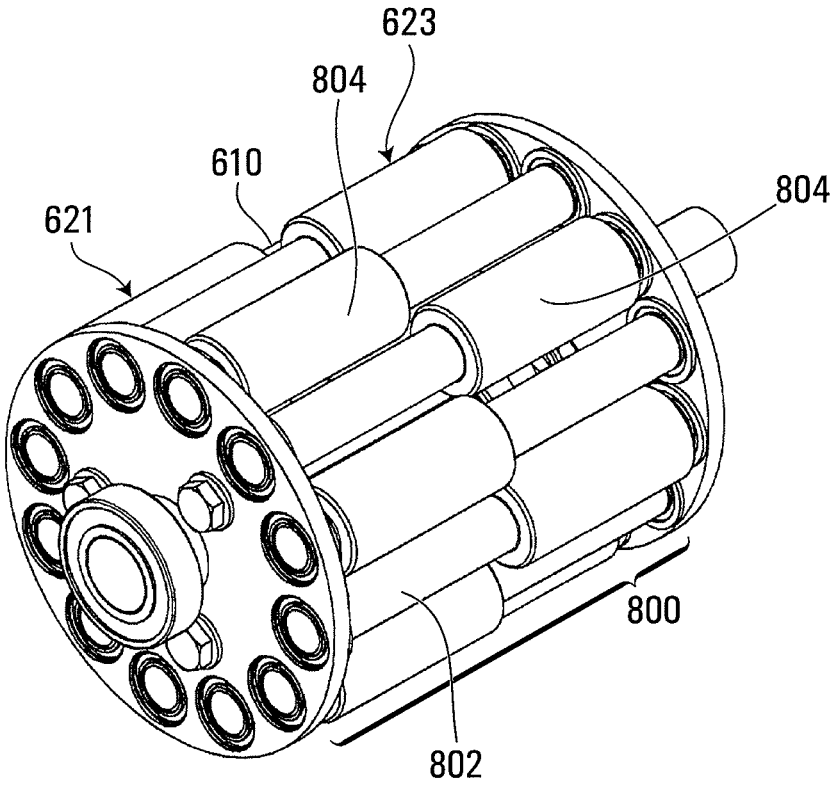
FIG. 11 is a perspective view of a pump rotor.

The rotor 610 is shown in greater detail at FIG. 11. The rotor 610 has a cylindrical body dimensioned to fit in the circular cavity defined by the pump body when the cover 618 is mounted to the pump body base 617. The rotor 610 includes a series of drive pins that are peripherally arrayed. Each drive pin 800 includes a shaft 802 and an enlarged cylindrical body 804 that constitutes a lobe for compressing the flexible tube during the pumping operation. The cylindrical body 804 (lobe) is rotatably mounted on the shaft 802 such that it engages the flexible conduit in a rolling contact as the rotor is turning.

The arrangement of the lobes 804 on the rotor 610 is such that they alternate to create a pair of pumping mechanisms 621 and 623, extending side-by-side.

Figure 12:
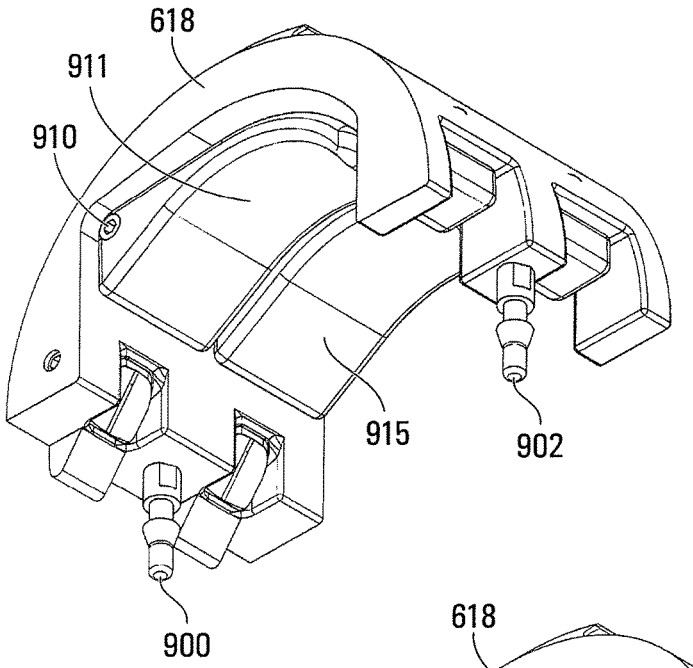
FIG. 12 is a perspective view of a pump cover.
Figure 13:
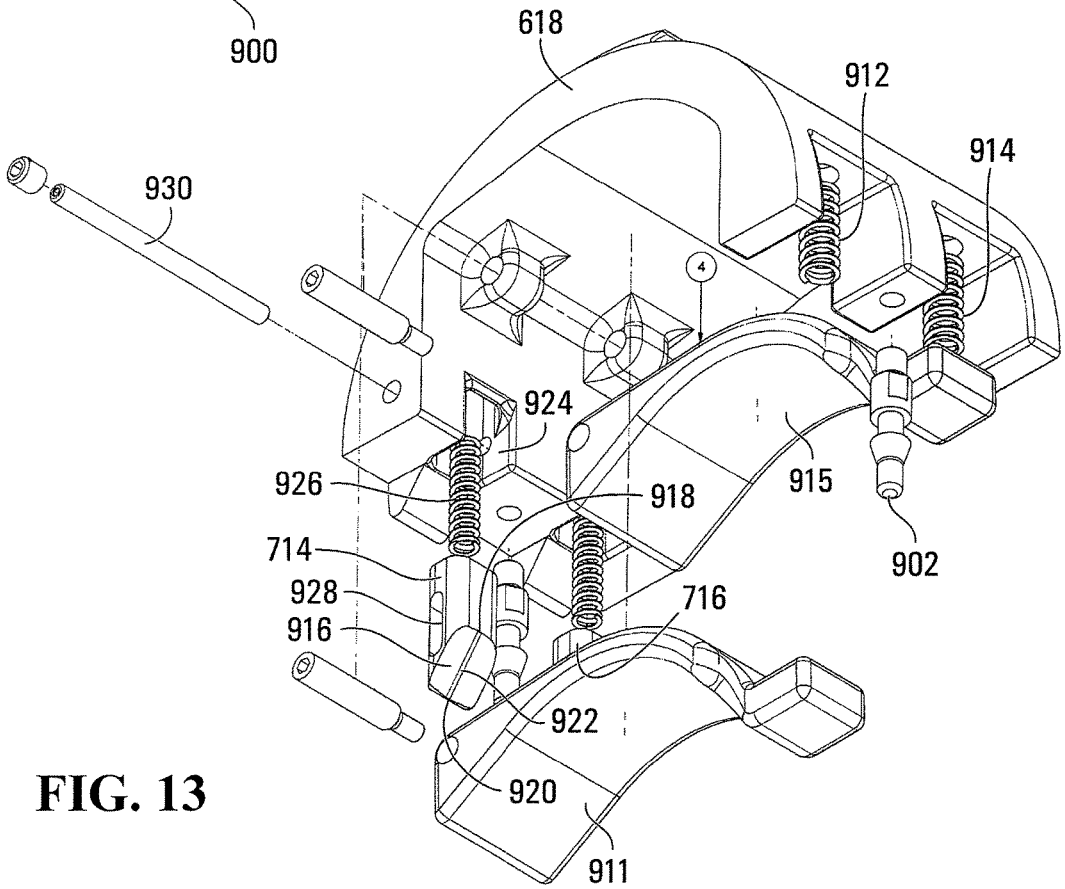
FIG. 13 is it similar to FIG. 12, showing the relationship between several components of the pump that are mounted to the pump cover.

The cover 618 is illustrated in greater detail at FIGS. 12 and 13. The cover 618 is designed to mate with the pump body base 617 and it is retained to the pump body base 617 by a locking mechanism, including interlocking components mounted to the pump body base 617 and to the cover 618. In the example shown, the interlocking components include locking pins 900 and 902 releasably engaging the quick release latches 736 and 738. To engage to cover 618 on the pump body base 617, the pins 900 and 902 are aligned with the openings on top of the quick release latches 736 and 738 and snapped in place. To release the cover 618, the quick release latches 736 and 738 are inwardly depressed against the resiliency of the coil springs to release the pins 900 and 902. To facilitate lifting of the cover 618 from the pump body base 617, a lift handle is provided on the cover 618. As shown in FIG. 7, the lift handle is defined by a pair of recesses 904 and 906.

The quick release latches 738 and 736 are located on opposite sides of the pump body base 617. Since the pump body base 617 is about the dimension of human hand, the operator can release the latches 738 and 736 simultaneously by depressing them with the index finger and the thumb. In this fashion, the locking mechanism can be released by a single hand operation, leaving the other hand free to grasp and lift the cover 618 by its lift handle.

In a specific example, the locking mechanism is designed in such a way as to allow the cover 618 to be mounted to the pump body base 617 in one single orientation, which is the correct orientation for the proper operation. This is achieved by making the locking pins 900 and 902 of different diameters and also sizing the apertures in the quick-release latches 738, 736 accordingly. In this fashion, to accidentally reverse the cover 618 since the locking pin 900,902 would no longer fit in the quick-release latch 738,736.

Note that the locking mechanism may vary from the one described herein, without departing from the spirit of the invention. Many different types of such mechanisms exist, using pins, latches or cams that can interlock when engaged one into the other, and that can be released by applying finger pressure.

The inner face of the cover 618, the one that faces the rotor 610, is provided with a pair of resiliently mounted fingers 911 and 915. The fingers 911 and 915 engage two runs of the flexible conduit and urge those runs in contact with the lobes 804 to enable the pumping action. The fingers 911 and 915 are of identical construction. Each includes a curved body that generally matches the periphery of the rotor 610. Each finger 911 and 915 is pivotally mounted at a pivot 910 to move toward and away from the rotor 610.

The fingers 911 and 915 engage coil springs 912 and 914 that urge the fingers 911 and 915 downwardly, toward the rotor 610. The spring biased fingers 911 and 915 thus urge the runs of the flexible conduit against the lobes 804 of the rotor 610. The degree of pressure applied on the runs of the flexible conduit is dependent on the resiliency of the coil springs 912 and 914. The stiffness of the material from which the flexible conduit is made determines in practice how much pressure would be required by the fingers 911 and 915 to completely collapse the conduit when it is engaged by a lobe 804.

The structure of the jaws 714 and 716 is best shown at FIG. 13. Jaw 714 has an elongated body with a slanted outer face 916. The slanted outer face has a first edge 918 and a second opposite edge 920. A recess 922 extends along the outer face from the edge 918 to the edge 920. As in the case with the jaw 710, the recess 922 is used to receive the flexible conduit.

The jaw 714 is received in a pocket 924 and it is biased by a coil spring 926. The coil spring 926 urges the jaw 714 to move downwardly, toward the jaw 710. The range of movement of the jaw 714 is determined by the extent of the slot 928. A stud 930 is received in the slot 928 to keep the jaw 714 seated in the pocket 924.

The structure of the jaw 716 is identical to the jaw 714.

In operation, when the cover 618 is seated on the pump body base 617, the jaws 710, 712 and 714, 716 inter-engage by pairs. In the case of the pair of jaws 710,714 the mating faces 916 and 726 engage the flexible conduit (not shown) on both sides. The same occurs with the pair of jaws 712,716.

The orientation of the mating faces 726 and 916 is such as to retain the run of flexible conduit in a position that will not create a sharp bend. The mating faces are thus oriented generally along a tangent of the curve along which the run of the flexible conduit extends as it passes through the peristaltic pump. That curve, will generally have a radius that is somewhat larger than the radius of the rotor 610.

Another way to describe this geometric relation is to consider the imaginary straight line going through the section of the flexible tube that is clamped between the jaws 710 and 714. That imaginary line is oriented such that it will not intersect the periphery of the rotor 610.

The pair of jaws 712 and 716 works in the same way the only exception being that they engage a different run of the flexible conduit than jaws 710,714.

In use, when the pump is being run, two parallel runs of flexible conduit are installed side-by-side on the rotor 610, each run being engaged by a different array of lobes 804. Each run is pressed against the respective array of lobes by a respective finger 911, 915 and clamped by a respective set of jaws 710, 714 and 712 and 716.

The pressure exerted on the conduit by the mating faces 726 and 916 is determined by the stiffness of the coil springs 926 and 722. The pressure is selected such as to retain the flexible conduit in place and thus prevent it from moving in the pump due to the rotary movement of the lobes, but without collapsing the flexible conduit or partially constricting it sufficiently to materially impede the flow of liquid through it. The resiliency of the coil springs is selected on the basis of the stiffness of the material from which the flexible tube is made. The diameter of the tube, however, has a significantly lesser influence with the result that the same set of jaws can be used successfully with different tube diameters. The coil springs provide a sufficient degree of compliance such that adequate retention force can be generated even when the tube diameter changes.

In this fashion the peristaltic pump can be set for different production runs, each requiring a different tube diameter and without the need of making any change of parts or adjustments to the pump.

Figure 17:
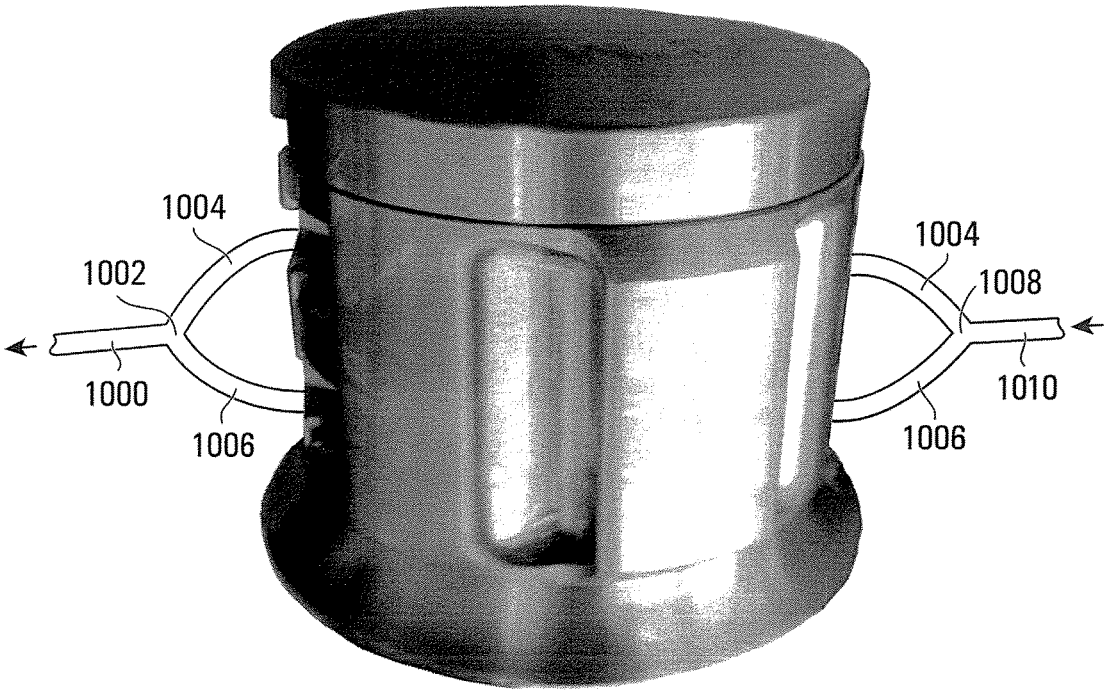
FIG. 17 is a top perspective view of the pump with the cover closed illustrating the routing of the flexible feed tube.

FIG. 17 illustrates the manner in which the flexible conduit through which liquid is being pumped is routed through the pump. The conduit inlet is shown at 1010. A Y connection 1008 splits the inlet section 1010 in two generally parallel runs 1004 and 1006 that each extend through the pump. The runs 1004 and 1006 exit the pump and are connected by a Y connection 1002 to a common outlet 1000.

Figure 14:
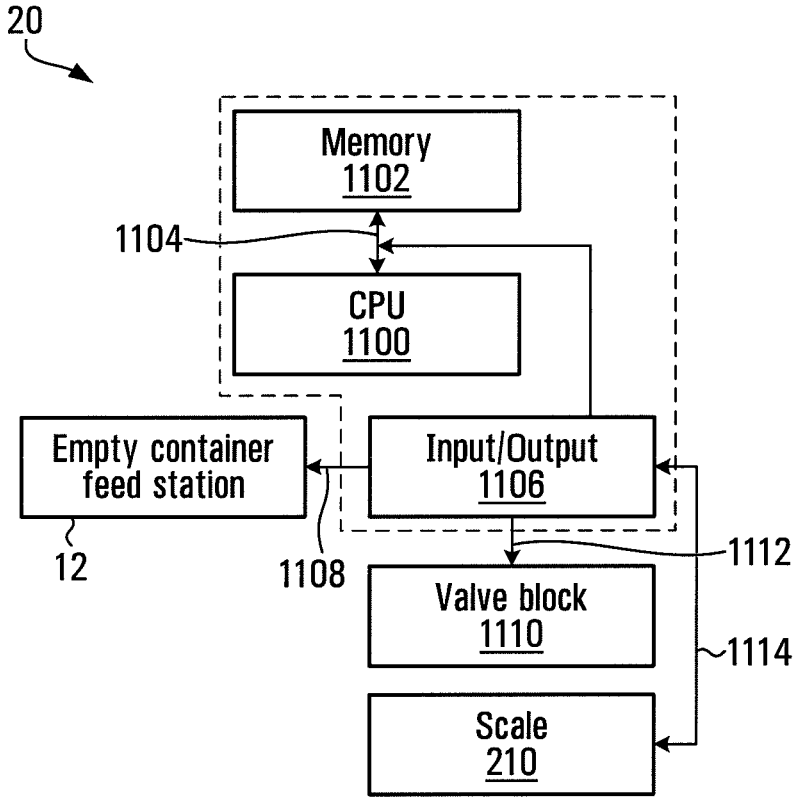
FIG. 14 is a block diagram of the electronic pump control.

FIG. 14 is a more detailed block diagram of the pump control 20, also illustrating peripheral components that interact with the pump control 20. The pump control 20 is essentially a computing device designed to perform computations on data signals and generate control signals to operate various components of the pump and also components of the container filling apparatus in which the pump is installed. The pump control 20 has a CPU 1100, connected to a machine-readable storage 1102 via a data bus 1104. The machine-readable storage 1102, commonly referred to as "memory" is encoded with program instructions to be executed by the CPU 1100. The program instructions define the functionality that is provided by the pump control 20. The memory 1102 also stores data on which the program instructions operate. Such data can be entries made by the operator via the control panel 208 and data output by the scale 210, among others.

An input/output interface 1106 connects with the data bus 1104. Data input to the to the pump control 20 goes through the input output interface 1106. Similarly, control signals generated as a result of the execution of the program code are directed to the input output interface 1106 and are then transmitted to the appropriate peripheral.

Three such peripherals are illustrated in FIG. 14. One is the empty container feed station 12 that supplies empty containers to be filled with liquid. A data connection 1108 is provided between the input/output interface 1106 and the empty container feed station 12 allowing the pump control 22 to regulate certain aspects of the operation of the feed station 12.

Yet another peripheral is a valve block 1110 that communicates with the input/output interface 1106 via the data connection 1112. The valve block 1110 is used to selectively discharge doses of liquid pumped by anyone of the peristaltic pump modules 18 into the scale 210 so that the dose can be weighted. The structure of the valve block 1110 will not be described in detail. Many different valve block configurations are possible without departing from the spirit of the invention. It suffices to say that the valve block 1110 is an array of individual valves that can be opened or closed selectively in response to digital signals output by the pump control 20. The valve block 1110 can, therefore, selectively establish a fluid connection between the output of any given peristaltic pump modules 18 and the scale 210. In this fashion, a dose of liquid pumped by anyone of the pump modules 18 can be diverted to the scale 210 allowing to perform self calibration or to check periodically during a production run that the amount of liquid dispensed is accurate.

Scale 210 is yet another peripheral that is controlled by the pump control 20. Note that the connection 1114 between the input-output interface 1106 and the scale 210 is bidirectional. Such bi-directional connection implies that the data connection 1114 carries signals both ways, namely control signals directed to the scale 210 and response and/or data generated by the scale 210 for processing by the pump control 20.

Figure 15:
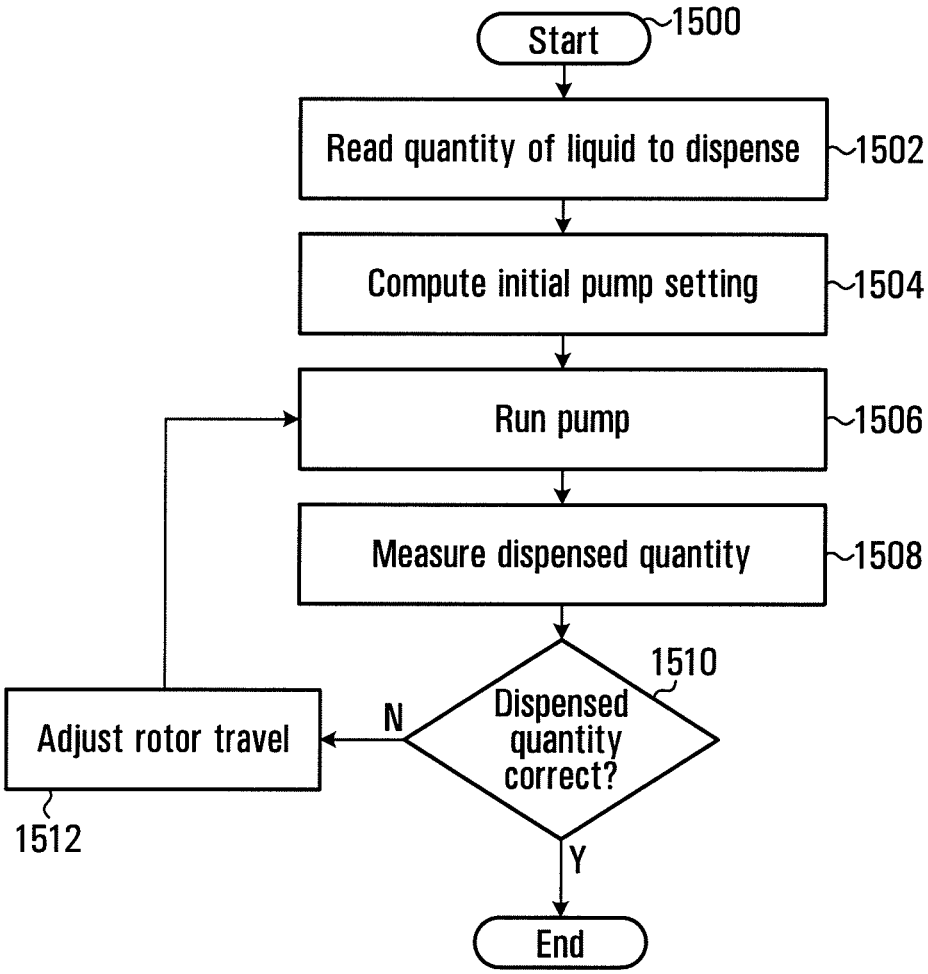
FIG. 15 is a flowchart of a process for performing the pump self-calibration.

FIG. 15 illustrates a flowchart of a process performed under control of the pump control 20 to calibrate the individual peristaltic pump modules 206. The process starts at 1500. At step 1502 the pump control 20 reads the quantity of liquid that is to be dispensed for the peristaltic pump module 206. This data would typically be input by the operator via the control panel 208. For example, the data would indicate the quantity of liquid in cubic centimeters that the pump module 18 is to dispense at each dispensing cycle (dose). Based on that input, the pump control 20 will compute an initial setting at step 1504 for the peristaltic pump 18. This can be performed in many ways, one example being to provide a lookup table mapping liquid quantities to corresponding angular movement through which the peristaltic pump module 18 should go to achieve the desired liquid volume.

At step 1506 the peristaltic pump module 18 is run according to the computed initial setting. The output of the pump is directed to the scale 210 by sending the control signals to the valve block 1110. The control signals operate a valve to direct the output of the pump module 18 to the scale 210. The scale 210 weighs the amount of discharged liquid and communicates the data representing the weight value to the pump control 20. On the basis of the weight information, the pump control 20 will compute at step 1508 the volume of liquid that has actually been dispensed. This is done by factoring in the liquid density, which is a parameter that can be supplied by the operator via the control panel 208.

At decision step 1510 the pump control 20 will compare the initial setting to the actual volume delivered. If an error exists, the pump control 20 computes at step 1512 a rotational correction to adjust the angular movement of the rotor 610 necessary to achieve the desired liquid quantity. The adjustment may be such as to increase the angular movement or decrease it.

If a rotational adjustment is required, the process is repeated to ensure that the liquid quantity delivered is precise. The peristaltic pump module 18 is run one more time with the corrected angular movement and the quantity of liquid weighed again. When the quantity of liquid delivered matches the set quantity, the process terminates and the pump is considered to be calibrated.

The process of FIG. 15 can be run a number of times during the operation of the filling station. Typically, the process would be run at the beginning of the production run when the machine is being prepared to fill a batch of containers with a certain liquid. However, the process can also be run when the filling operation is underway. For example, the pump calibration process can be run periodically to ensure that the quantity delivered in each container has not drifted and remains accurate.

The difference when running the pump calibration operation when the filling is underway and before beginning the filling cycle is the requirement to manage the flow of empty containers. Since the liquid discharged by the pump is now diverted to the scale 210, that liquid is not available to be delivered into containers. The pump control 20, manages this process by controlling the inflow of empty containers such as to interrupt temporarily the inflow while the pump calibration operation is performed. In other words, during the normal operation of the filling station 10, a constant stream of empty containers linearly arranged on a conveyor belt is carried to the dispensing station 16. A temporarily interruption of the dispensing of containers on the conveyor belt will produce a container-less interval in the stream which is timed with the pump calibration operation.

Figure 16:
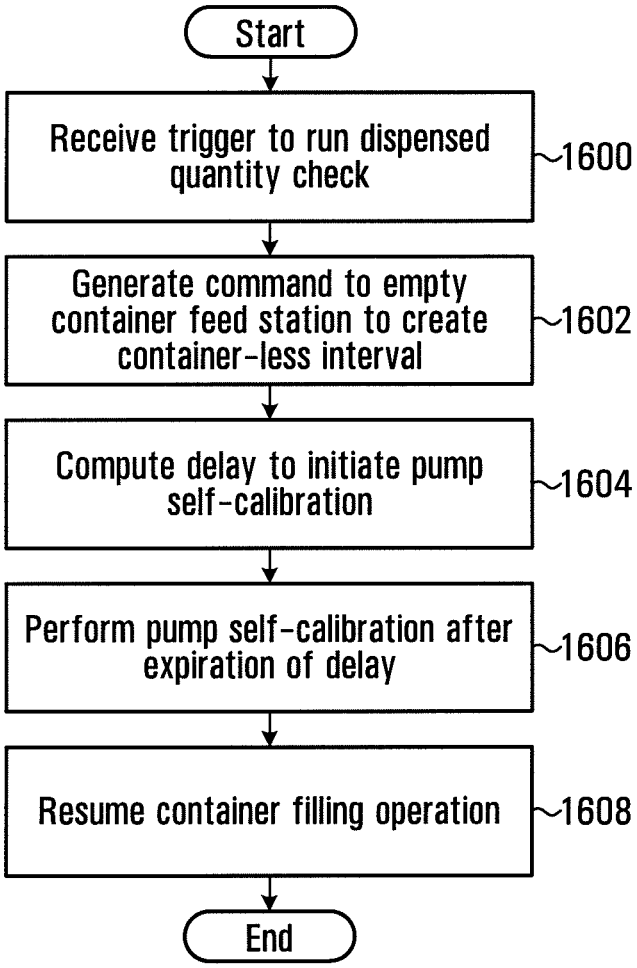
FIG. 16 is a flowchart of a process to control the operation of the empty container feed station during an operation performed to verify if the quantity of liquid that is being dispensed is the same as the nominal quantity.

The flowchart at FIG. 16 describes the process. At step 1600 the pump control 20 triggers the calibration procedure. The trigger can be a software timer that will periodically output a control signal to invoke the program code for running the calibration operation.

The pump control 20 manages the synchronization between the container feed station 12 and the pump 206 during the calibration procedure. What this means is that the pump calibration procedure is initiated when the container-less interval in the stream of empty containers reaches the dispensing station 16. Since the speed of travel of the containers is known, which is effectively the speed of the conveyor belt, the pump control 20 can compute the time necessary for the beginning of the container-less interval to reach the dispensing station 16, once the empty container feed station 12 has stopped dispensing empty containers on the conveyor belt, hence initiating the formation of the container-less interval.

In practical terms, once the pump control 20 has sent a signal to the container feeding station 12 to stop dispensing containers for initiating the interval, the pump control 20 will delay the beginning of the self calibration operation (step 1602) by a time period corresponding to the time of travel of the container-less interval to the dispensing station 16. In this fashion, the self-calibration operation will begin at the time when the container-less interval reaches the dispensing station 16 (step 1604).

Instead of creating a container-less interval, it is possible to simply divert the flow of containers reaching the dispensing station 16 during a period of time necessary to complete the pump calibration procedure. This approach is simpler since it does not require synchronization other than triggering at the time the pump is no longer available to dispense liquids in the empty containers, a gate or any other suitable device to divert the flow of empty containers and stop the diversion when the pump calibration procedure is completed and the pump is back online.

For instance, when the container-filling machine uses star-wheels or feed screws to supply empty containers to the dispensing station 16 in the correct order, it possible to block the entrance to the star-wheel or feed screw such as to create the container-less interval.

Once the pump self-calibration operation is completed, the empty container filling station resumes, as shown at step 1606. The operation resumes when the pump control 20 has completed the internal data processing to set the angular movement of the rotor 610, if any correction was required. At that moment, the pump control 20 generates a control signal to the empty container feed station to command that station 12 to resume dispensing empty containers on the conveyor belt. To account for the travel time of containers, the liquid dispensing operation is delayed by the same period of time determined at step 1602, such that the liquid dispensing operation will be timed with the arrival of the container-less interval.

Variants are possible without departing from the spirit of the invention. One such variant is the provision of a sensor in the pump 602 to prevent unwanted operation of the pump 602 when the cover 618 is opened for servicing the pump 602. The sensor can be any sensing device that can detect when the cover 618 is separated from the pump body base 617, or when the cover 618 is not fully seated on the pump body base 617. An example of such sensing element is an electrical switch having an actuator. The electrical switch can be mounted to the pump cover 618 or to the pump body base 617, such that the actuator is depressed when both components are assembled in order to close or open an electrical circuit, as the case may be and indicate that the cover 618 is fully seated on the pump body base 617.

Instead of using such electrical/mechanical switch it is possible to use a magnetic switch responsive to a magnetic field in the proximity of the switch. The switch can be mounted to the pump body base 617 and a permanent magnet is mounted to the pump cover 618, which is adjacent the magnetic switch when the cover 618 is closed. In this fashion, when the cover 618 is closed, the electrical conduction status of the magnetic switch will change due to the presence of the permanent magnet.

Yet another possibility is to use a proximity sensor that does not require any physical contact to detect the presence of a target object. Different types of proximity sensors exists, such as inductive sensors, capacitive sensor, etc.

The output of the sensing device is detected by the pump control 20 and it prevents operation of the pumping module 18, if showing that the cover 618 is not fully seated on the pump body base 617.

The invention claimed is:

1. A peristaltic pump, comprising:

(a) a pump base;

(b) a rotor mounted to said pump base, the rotor having a conduit engaging side for engaging a flexible conduit;

(c) a cover member including a conduit backing side, the cover member being selectively moveable relative to the pump base between a working position and a released position, in the working position the conduit backing side being proximal to the conduit engaging side of the rotor such that the rotor pumps fluid through the flexible conduit, in the released position the cover member being distal to the conduit engaging side allowing removal of the flexible conduit from the peristaltic pump;

(d) the conduit backing side and the conduit engaging side defining a pumping interface at which fluid contained in the conduit is displaced through the conduit by the rotor;

(e) a conduit retainer mechanism for engaging the flexible conduit to assist with retention of the flexible conduit against displacement resulting from engagement between the flexible conduit and the rotor, the conduit retainer mechanism including a first component and a second component;

(1) the first component being mounted to the pump base;

(2) the second component being mounted to the cover member, the first and the second components being configured to cooperate to engage the flexible conduit there between when the cover is moved to the working position; and (3) the first and the second components being configured to cooperate to engage the flexible conduit at a location that is remote from the pumping interface, wherein the conduit retainer mechanism includes a resilient component that resiliently acts against the flexible conduit.

2. A peristaltic pump as defined in claim 1, wherein the cover member engages the pump base when the cover member is in the working position.

3. A peristaltic pump as defined in claim 2, including a spring member mounted to the cover member for resiliently urging the second component toward the flexible conduit.

4. A peristaltic pump as defined in claim 3, including a spring member mounted to the pump base for resiliently urging the first component toward the flexible conduit.

5. A peristaltic pump as defined in claim 1, wherein the cover member in the released position is unattached to the pump base allowing complete separation of the cover member from the pump base.

6. A peristaltic pump as defined in claim 5, including a latch for securing the cover member to the pump base when the cover member is in the working position.

7. A peristaltic pump as defined in claim 1, wherein the cover member when in the released position is movable to the working position by displacing the cover member along a direction of movement, the conduit retainer mechanism including a spring configured to compress along the direction of movement.

8. A peristaltic pump as defined in claim 1, including a spring-biased finger defining the conduit backing surface, the spring biased finger resiliently pressing on the flexible conduit when the cover member is in the working position.

* * * * *